US008980620B2

(12) United States Patent
Dettman et al.

(10) Patent No.: US 8,980,620 B2
(45) Date of Patent: Mar. 17, 2015

(54) PETROLEUM BIOCONVERSION OF ORGANIC ACIDS TO PREVENT REFINERY CORROSION

(75) Inventors: Heather D. Dettman, Edmonton (CA); Ryan Lister, Edmonton (CA); Louis D. Heerze, Edmonton (CA)

(73) Assignee: Her Majesty the Queen in Right of Canada as Represented by the Minister of Natural Resources, Ottawa (CA)

( * ) Notice: Subject to any disclaimer, the term of this patent is extended or adjusted under 35 U.S.C. 154(b) by 686 days.

(21) Appl. No.: 13/265,614

(22) PCT Filed: Apr. 24, 2009

(86) PCT No.: PCT/CA2009/000552

§ 371 (c)(1),
(2), (4) Date: Oct. 21, 2011

(87) PCT Pub. No.: WO2010/121343

PCT Pub. Date: Oct. 28, 2010

(65) Prior Publication Data

US 2012/0034683 A1 Feb. 9, 2012

(51) Int. Cl.
*C10G 32/00* (2006.01)
*C10G 75/02* (2006.01)

(52) U.S. Cl.
CPC ..... *C10G 32/00* (2013.01); *C10G 75/02* (2013.01); *C10G 2300/1033* (2013.01); *C10G 2300/203* (2013.01); *C10G 2300/4075* (2013.01)
USPC ..... 435/281; 435/166; 435/170

(58) Field of Classification Search
None
See application file for complete search history.

(56) References Cited

U.S. PATENT DOCUMENTS

2012/0028341 A1* 2/2012 Heerze ..... 435/281

FOREIGN PATENT DOCUMENTS

CA 2343769 A1 4/2000
CA 2345271 A1 4/2000
WO WO 02099013 A2 * 12/2002

OTHER PUBLICATIONS

Del Rio, LF et al. Degradation of naphthenic acids by sediment micro-organisms. Journal of Applied Microbiology. 2006. 101: 1049-1061.*

Patent Cooperation Treaty, PCT International Search Report and Written Opinion of the International Searching Authority for PCT/CA2009/000552 dated Dec. 31, 2009, 10 pages.

European Patent Office, Supplementary European Search Report for EP09843490 dated Sep. 6, 2012, 7 pages.

Cheesbrough et al., "Alkane biosynthesis by decarbonylation of aldehydes catalyzed by a particulate preparation from *Pisum sativum*," 1984, pp. 6613-6617, Proceedings of the National Academy of Sciences USA, Biochemistry, vol. 81 (XP-002682083).

Tornabene, "Formation of Hydrocarbons by Bacteria and Algae," 1980, 18 pages, Symposium on Trends in the Biology of Fermentations for Fuels and Chemicals, Brookhaven National Laboratory (XP-002682084).

Han et al., "Biosynthesis of Alkanes in *Nostoc muscorum*," 1969, pp. 5156-5159, Journal of the American Chemical Society, vol. 91, No. 18 (XP-002682085).

Pointis et al., "Reversible unidirectional inhibition of sucrose synthase activity by disulfides," 1981, pp. 6667-6669, Proceedings of the National Academy of Sciences USA, Biochemistry, vol. 78, No. 11 (XP-002682086).

Ladygina et al., "A review on microbial synthesis of hydrocarbons," 2006, pp. 1001-1014, Process Biochemistry, vol. 41.

* cited by examiner

*Primary Examiner* — Allison Fox
*Assistant Examiner* — Susan E Fernandez
(74) *Attorney, Agent, or Firm* — Hoffman Warnick LLC

(57) ABSTRACT

The present invention relates to the use of microorganisms (biocatalysts), or catalysts derived from these organisms (enzymes), to improve the quality of crude oil and bitumen as an attractive alternative to current upgrading methods. The invention identifies and characterizes the microorganism species, in particular, *N. muscorum* (UTEX 2209) and *Kocuria rhizophilia* (ATCC533), that have the capability to biochemically convert organic acids into chemical species that do not possess corrosive properties.

7 Claims, 11 Drawing Sheets

Two products

Four products

Two products

One product

Product 1, M 222

Product 2, M 164

Product 3, M 208

Product 4, M 178

Product 5, M 192

PETROLEUM BIOCONVERSION OF ORGANIC ACIDS TO PREVENT REFINERY CORROSION

FIELD OF THE INVENTION

This invention relates to the use of microorganisms (biocatalysts), or catalysts derived from these organisms (enzymes), to improve the quality of crude oil and bitumen as an attractive alternative to current upgrading methods. The invention identifies and characterizes the microorganism species that have the capability to biochemically convert organic acids into chemical species that do not possess corrosive properties.

BACKGROUND OF THE INVENTION

The quality of crude oil throughout the world is reduced by acidic components found in the oil. During refining, at temperatures between 220 and 400° C., these species can become corrosive. Organic acid species commonly referred to as naphthenic acids, having boiling points in this temperature range will condense on metal surfaces leading to damage in the refinery infrastructure, potential safety issues, and costly repairs. As a result, oils with high acid content, whether from conventional (crude oil) or oil sands (bitumen) sources, are more difficult to market and their value is significantly discounted.

Total acid number (TAN) is an analysis that tends to correlate with the corrosive nature of oils. Most refineries will minimize their exposure to oils with TAN values greater than 0.5 mg potassium hydroxide (KOH) per gram of oil. Some newer refineries have improved their front-end metallurgy so that they can handle TAN values up to 1.0 mg KOH/g. However, bitumens and heavy crude oils can have TAN values greater than 2.0 mg KOH/g.

Organic acids contribute significantly to the corrosion problems in refineries (Meredith et al. in *Organic Geochemistry,* 2000, 31, 1059-1073). In Alberta, *Athabasca* oil sands contain significant amounts of organic acids that are problematic not only to the refineries that receive the bitumen, but contribute to the toxicity of the waters used during bitumen extraction (Holowenko et al. in *Water Research,* 2002, 36, 2843-2855; and Rogers et al. in *Chemosphere,* 2002, 48, 519-527). The Canadian Oil Sands Network for Research and Development (CONRAD) Upgrading Research Group has identified that high total acid number (TAN) values, a number that reflects the corrosive nature of crude oil, pose a major concern to the industry that are processing Alberta bitumens and heavy crudes.

Conventional methods to remove corrosive species from crude oil involve costly and energy-intensive chemical and thermal processes. For example, the current technologies developed to remove organic acids from crude oil involve either thermal decomposition at 400° C. (Blum et al. in U.S. Pat. No. 5,820,750), adsorbing onto inert materials (Varadaraj in U.S. Pat. No. 6,454,936), treating with surfactants (Gorbaty et al. in Canadian Patent 2,226,750) or converting the organic acids into various derivatives that are easier to remove (Brons in U.S. Pat. No. 5,871,637, Sartori et al. in Canadian Patents 2,343,769 and 2,345,271, and Varadaraj et al. in U.S. Pat. No. 6,096,196).

Efforts to minimize organic acid corrosion have included a number of approaches for neutralizing and removing the acids from the oil. For example, there are numerous approaches in the literature on the reduction of the organic acid species in crude oil. They include thermal decomposition of organic acids using high temperatures in the presence (U.S. Pat. Nos. 5,914,030, 5,928,502) or absence (U.S. Pat. No. 5,820,750) of a metal catalyst and treatment of corrosive acids with group IA and IIA metal oxides, hydroxides and hydrates to form metal salts of naphthenic acids which are then thermally decomposed at elevated temperatures (U.S. Pat. Nos. 5,985,137, 5,891,325, 5,871,637, 6,022,494, 6,190,541, 6,679,987). Other methods include chemical formation of esters of the organic acids in the presence of alcohol and a base (U.S. Pat. Nos. 5,948,238, 6,251,305, 6,767,452, and Canadian Patent 2,343,769), reducing acidity by the formation of various salts of organic acids using base (U.S. Pat. Nos. 5,643,439, 5,683,626, 5,961,821, 6,030,523), removal of naphthenic acids using detergents or surfactants (U.S. Pat. Nos. 6,054,042, 6,454,936), absorbing organic acids onto polymeric amines (U.S. Pat. Nos. 6,121,411, 6,281,328) and by adding corrosion inhibitors to crude oil to prevent naphthenic acid induced metal corrosion (U.S. Pat. No. 5,552,085).

While these processes have achieved varying degrees of success, most of these methods are costly and energy-intensive and their effectiveness somewhat limited. As a result, there is a need to develop alternative approaches to treat and eliminate organic acid species in petroleum.

An alternative to utilizing energy intensive thermal, physical or chemical methods may be a biological approach using enzymes that have the capability to remove or convert the acidic carboxyl groups from organic acids into products that are not corrosive.

The art is substantially bereft of methods for upgrading the quality of crude oil comprising organic and/or naphthenic acids by the use of enzymes or biocatalysts. U.S. Pat. Nos. 7,101,410, 6,461,859 and 5,358,870 describe the use of biocatalysts, such as bacteria, fungi, yeast, and algae, hemoprotein, and a cell-free enzyme preparation from *Rhodococcus* sp. ATCC 53969, respectively, to improve the quality of oil specifically target organic sulphur containing molecules and so reduce the sulphur content as well as lowering their viscosity. U.S. Pat. No. 5,858,766 describes the use of microorganisms (a bacteria strain) in a bioupgrading capacity to selectively convert organic nitrogen and sulphur molecule in oil as well as remove metals.

It has been reported that *Micrococcus luteus* (formerly *Sarcina lutea*) ATCC 533 can convert fatty acids into long chain hydrocarbons via a decarboxylation-condensation mechanism (Albro et al. in *Biochemistry,* 1969, 8, 394-405, 953-959, 1913-1918 and 3317-3324). The organism is now known as *Kocuria rhizophilia* and has similar characteristics to a closely related organism *M. luteus*. This microorganism is one of a group of microorganisms and plants that possess enzymes that may be useful in a bioupgrading process that can biosynthesize hydrocarbons from carboxylic acids. The organisms and plants are described in a series of review articles (Hackett L. P. in *Microb. Biotechnol.* 2008, 1, 211-225; Ladygina, et al. in *Proc, Biochem.* 2006, 41, 1001-1014; Khan et al. in *Biochem. Biophys. Res. Comm.* 1974, 61 1379-1386; and Kolattukudy et al. in *Biochem. Biophys. Res. Comm.* 1972, 47, 1306-1313).

There remain the needs for bioprocesses, as attractive alternatives to current upgrading methods, which use microorganisms (biocatalysts), or catalysts derived from these organisms (enzymes), to improve the quality of crude oil and bitumen by converting organic acidic species.

SUMMARY OF THE INVENTION

The present invention is directed to bioupgrading, i.e., using enzymes to improve the quality of crude oil and bitumen. The advantages of bioupgrading technologies lie in that they operate under much milder conditions, for example, at lower temperatures and pressures, compared to those required by conventional technologies. Consequently, much less energy will be required. As a result, the environmental impacts would be reduced. Furthermore, since biocatalysts and enzymes are specific in their conversions, only the undesirable components—in this case, corrosive species—are converted into non-corrosive ones without affecting the rest of the crude oil. The result is an improvement in the overall quality of the oil and refinery corrosion prevention.

The present invention identifies a bioupgrading use for enzyme activities isolated from microorganisms and plants that possess the ability to biosynthesize hydrocarbons from carboxylic acids. By example the invention is described by the enzymes isolated from two hydrocarbon synthesizing microorganisms. The two sources of enzymes include one from a blue green algae *Nostoc muscorum* and the other from a bacterial source *Kocuria rhizophilia*. Both demonstrated enzyme activity that can convert a number of simple organic acid analogs into products. Furthermore, a closely related organism *Micrococcus luteus* had similar enzyme activities. The activities appeared to be unique to these species. In all cases, the enzymes did not require any cofactors to complete their biochemical conversions.

The enzymes appeared to work best at a pH≈8 in the presence of low concentrations of magnesium chloride and a reducing agent dithiothreitol. Preliminary identification of a series of products produced by *K. rhizophilia* was made. The products appeared to be alkene products that are generated through a decarboxylation-condensation mechanism as well as a series of alcohols that are produced by a chain elongation-decarboxylation mechanism. Significant progress has been made in the purification of the enzyme activities from. *K. rhizophilia*. The enzymes can be purified using a combination of ammonium sulfate precipitation and either hydrophobic interaction, ion exchange chromatography or affinity chromatography.

A similar approach will be used to purify the enzymes from *N. muscorum* using ammonium sulfate precipitation and affinity chromatography. The products from the enzyme sources were identified. The results from the *Nostoc* enzyme studies show that a model organic acid was converted into three products, an alkene, alcohol and ketone via a mechanism that involves a chain elongation followed by a decarboxylation reaction. This proposed mechanism identified for *Nostoc* is consistent with other algae species.

In one aspect of the present invention, it discloses a process for decreasing the acidity of an acidic crude oil, comprising:

a. contacting an acidic crude oil with at least one enzyme, in a buffer solution at a suitable pH, and
b. incubating the mixture obtained from step (a) under suitable conditions to convert the acids in the crude oil to non-corrosive products.

BRIEF DESCRIPTION OF THE DRAWINGS

The invention will now be described by way of reference to the drawings, in which.

DETAILED DESCRIPTION OF THE INVENTION

Figure 1:
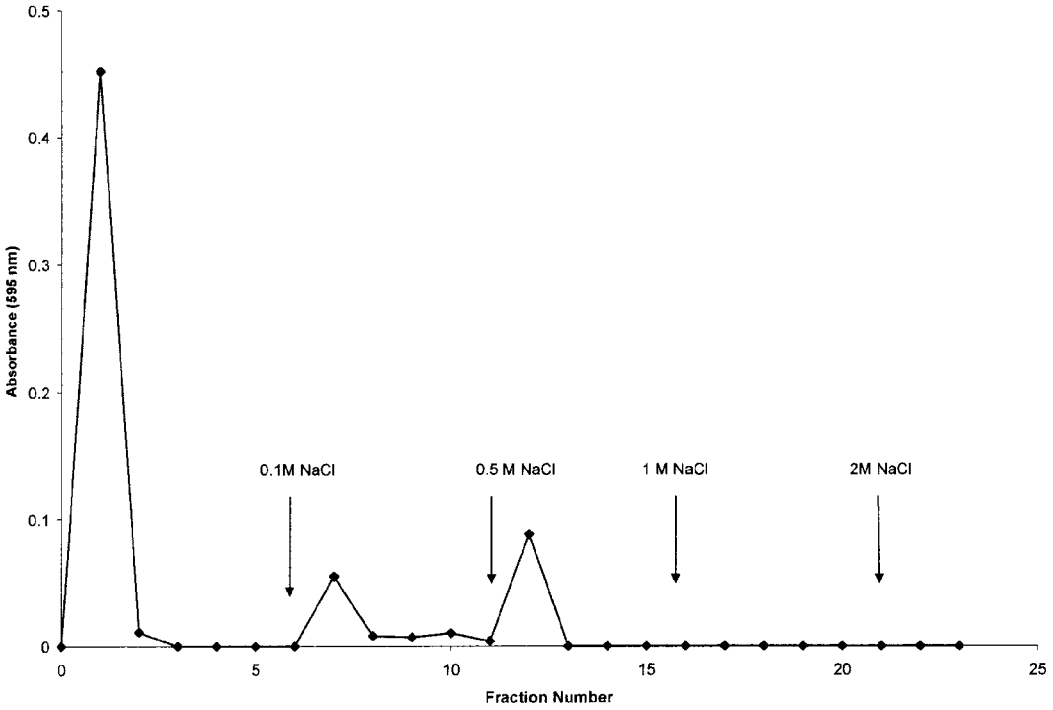
FIG. 1 is a trial purification of enzyme activities from an ammonium sulfate fraction from *N. muscorum* UTEX 2209 using myristoyl-Toyopearl

Crude oils can contain organic acids that are comprised mainly of naphthenic acids that contribute to corrosion of refinery equipment at elevated temperature.

The present invention discloses that when organic acid model analogs are treated with enzymes, in particular, *N. muscorum* (UTEX 2209) or *Kocuria rhizophilia* (ATCC533) in a buffer solution comprising $MgCl_2$ and dithiothreitol (DTT) with a pH at 8, the mixture of which is incubated at 30° C., the organic acid model analogs are converted into non-corrosive products.

The present invention may be demonstrated with reference to the following non-limiting examples.

GENERAL CONDITIONS

Materials and Methods

All chemicals and supplies used for the experiments described in this report were obtained from Fisher Scientific Company, Whitby, Ontario or VWR Scientific, Oakville, Ontario, Canada, with the following exceptions: 4-Phenylbutyric acid, trans-styrylacetic acid, indan-2-carboxylic acid, 2-cyclopentene-1-acetic acid, propyl benzene, trans-beta-methylstyrene, indan, 1-methyl-1-cyclopentene, Trizma base, Blue-Sepharose and chicken egg lysozyme were obtained from Sigma Aldrich Canada Ltd., Oakville, Ontario, Canada. The bacteria *Kocuria rhizophilia* (ATCC 533) and *Micrococcus luteus* (ATCC 4698) were purchased from the American Type Culture Collection, Manassas, Va., USA while the bacterium *Escherichia coli* B5 was obtained from the culture collection of the Department of Biological Sciences at the University of Alberta located in Edmonton, Alberta, Canada. Microbiological media used for culturing the microorganisms was obtained from Becton, Dickinson and Company, Sparks, Md., USA. Four strains of algae *Nostoc muscorum* (UTEX 2209), *Synechococcus elongatus* (UTEX 2434), *Anabaena variabilis* (UTEX B2576) and *Syn-*

*echocystis* sp (UTEX 1598) were from the collection of the University of Texas at Austin, Tex., USA. The ion exchange resins SP-, CM-, QAE- and DEAE-Sephadex as well as hydrophobic resins Phenyl and Butyl-Sepharose were from GE Healthcare, Baie D'urfe, Quebec, Canada. Protein determination reagents were from Bio-Rad Laboratories Canada Ltd, Mississauga, Ontario, Canada. Aluminum-backed silica-based thin layer chromatography plates (Merck Kieselgel $60_{(F254)}$) were from VWR Scientific, Oakville, Ontario, Canada.

Preparation of Palmitoyl-Toyopearl

Toyopearl (AF-amino-650M) resin (1 g) was washed extensively (100-mL) with methylene chloride. The freshly washed resin was added to a solution of palmitoyl chloride (0.5-mL, 0.45 g, 1.65 mmol) in 5-mL of dry methylene chloride. The coupling reaction proceeded for 24 h with constant mixing at room temperature. After reaction, the resin was removed by filtering and then washed with 50-mL of methylene chloride followed by 50-mL of $H_2O$. The coupled Toyopearl resin was then suspended in 50 mM Tris pH 7.3 buffer. The efficiency of the coupling reaction was determined by measuring the amount of unreacted starting material in the reaction supernatant by GC-MS. The results indicated that 1.34 mmol had coupled to the Toyopearl resin.

Preparation of Myristoyl-Toyopearl

Toyopearl (AF-amino-650M) resin (1 g) was washed extensively (100-mL) with methylene chloride. The filtered Toyopearl resin was added to a solution that contained myristoyl chloride (0.5-mL, 0.45 g, 1.84 mmol) and 5-mL of dry methylene chloride. The coupling reaction was gently mixed on an end-over-end rotator for 24 h at room temperature. After reaction, the resin was removed by filtering and then washed with 50-mL of methylene chloride followed by 50-mL of $H_2O$. The coupled Toyopearl resin was then suspended in 50 mM Tris pH 7.3 buffer. The efficiency of the coupling reaction was determined by measuring the amount of unreacted starting material in the reaction supernatant by GC-MS. The results indicated that 1.84 mmol of myristic acid had coupled to the Toyopearl resin.

Experiments Using *Nostoc muscorum*

1. Growth Conditions

*Nostoc muscorum* (UTEX 2209) was grown photo-autotrophically in a Coldstream incubator at 30° C. using sterile BG-11 growth medium. Cultures were maintained on BG-11 agar plates that were prepared from BG-11 media supplemented with 1% (w/v) Bacto-agar. Illumination was provided by fluorescent lamps at 150 microeinsteins $m^{-2}$ $s^{-1}$ with a 16-h-light-8-h-dark cycle. Aeration was provided by continuous bubbling with air and shaking on a rotary shaker at 150 rpm. Starter cultures were prepared by inoculating 50-mL of BG-11 media with *N. muscorum* from plates and incubating the cultures at 30° C. for 2 to 3 days. These starter cultures were then used to prepare larger starter cultures (3 to 500-mL) that were then incubated for an additional 3 to 5 days. These larger cultures were then used as inoculate for large scale production of *N. muscorum* on scales ranging from 1 to 5-L. For 5-L cultures of the organism, a magnetic stir bar was placed in the BG-11 culture media prior to sterilization. After inoculation, the culture was gently stirred using a magnetic stirrer. Air from the room, was bubbled into the culture using an aquarium pump.

2. Preparation of a Crude Extract of *N. muscorum*

After incubation, the cultures were transferred to 500-mL centrifuge bottles and centrifuged at 10,000×g for 30 mM. The resulting algae pellets were suspended in extraction buffer (100 mM Tris pH 8 containing 10 mM NaCl, 5 mM $MgCl_2$ and 1 mM dithiothreitol (DTT). The suspended algae were sonicated (5×30 sec with 1 min rest intervals) at 4° C. The broken cells were then centrifuged at 10,000×g for 30 min to yield Extract 1. The sedimented membranes were re-suspended in extraction buffer and then sonicated again (3×1 min with 3 min rest intervals). After centrifuging using the above conditions, this yielded a second extract. The extracts were combined (referred to as Extract 1) and made 40% saturated in ammonium sulfate by the slow addition of solid enzyme grade ammonium sulfate. The suspension was stirred for 4 h at 4° C. and the resulting precipitate was centrifuged at 10,000×g for 30 min. The resulting supernatant was carefully removed and then made 60% saturated in ammonium sulfate by the adding more solid and then stirred overnight. The solid protein precipitate from the first precipitation (40% saturation) was dissolved in a minimum amount of 50 mM Tris buffer (pH 7.3). After centrifuging using the same conditions as described above, the precipitate from the 60% saturation was also dissolved in 50 mM Tris buffer pH 7.3. To remove the salt from the protein solutions, both dissolved precipitates were transferred into dialysis tubing (8,000 molecular weight cutoff), and dialyzed exhaustively against 3 4-L changes (12 h each) of 50 mM Tris pH 7.3 buffer at 4° C. The amount of protein in each of the extracts and the dialyzed ammonium sulfate precipitate solutions were determined using a colorimetric assay based on the method of Bradford in *Analytical Biochemistry,* 1976, 72, 248-254. Enzyme activity was assessed using a thin layer chromatography (TLC) based assay as described below.

3. Trial Separation Using an Extract from *N. muscorum* and Myristoyl-Toyopearl Affinity Resin A 5-mL column (bed volume) of myristoyl-Toyopearl was prepared in 50 mM Tris buffer pH 7.3. Ten milliliters of the 60% ammonium sulphate cut was loaded onto the column and then equilibrated with the resin for 2 h at 4° C. After equilibration, the column were washed with 10 column volumes of 50 mM Tris buffer pH 7.3 to remove all of the non-adherent proteins. The myristoyl-Toyopearl column was then washed with 40-mL aliquots of pH 7.3 Tris buffer with increasing concentrations of NaCl (concentrations were 0.1, 0.5, 1 and 2 M NaCl). Ten milliliter fractions were collected throughout the process and each of the fractions were assayed for protein levels and fractions that contained protein were assayed for enzyme activity.

4. Determination of Enzyme Activity in *N. muscorum* Extracts

Enzyme activity was assessed by a chromatography based assay using phenylbutyric acid as the substrate. In a total volume of 0.2-mL contained enzyme and 31 mM phenylbutyric acid in 50 mM Tris buffer pH 8 containing 5 mM $MgCl_2$ and 5 mM DTT. Incubations were done in 1.5-mL microcentrifuge tubes for time intervals ranging from 1 to 24 h at 30° C. in a temperature controlled water bath. The progress of the reaction was monitored by removing 5-1 μL aliquots from the incubation mixture, and spotting them onto silica-based TLC plates that incorporated an ultraviolet indicator. The plates were then dried thoroughly. The products of the enzyme reaction were separated from the starting material using a 5% (v/v) ethyl acetate-heptane solvent system. Products were visualized using either an ultraviolet lamp set at 254 nm or by iodine vapor. The distance the unknown product had moved from the origin on the plates (Rf) were compared with the Rf of the expected product from a decarboxylation reaction using phenylbutyric acid as the substrate, propyl benzene.

To determine if cofactors affect product formation, pyridoxal phosphate, adenosine phosphate, pyridoxamine hydrochloride, nicotinamide adenine dinucleotide (NADH) and ascorbic acid were included in the assay mixtures at concentrations of 1.1 mM, 1.9 mM, 1.1 mM, 0.09 mM and 1.5 mM respectively. The product formation was compared to identical incubation mixtures that did not include the particular cofactor.

5. Large Scale Incubation of Enzyme from *N. muscorum* and Phenylbutyric Acid Phenylbutyric acid (5 mg, 30.4 mmol) was dissolved in 200-4 of 50 mM Tris buffer pH 8 containing 1 mM $MgCl_2$ and 1 mM DTT. One milliliter of the affinity purified enzyme was added to the reaction mixture and was allowed to proceed for 18 h with mixing at 30° C. in a temperature controlled water bath. At this point the progress of the reaction was monitored and incubation was continued for an additional 24 h. After incubation the reaction mixture was extracted with chloroform (4×0.5-mL). The chloroform extracts were combined and evaporated to dryness using a steady stream of nitrogen. The extracted material was dissolved in 200-μL of chloroform and analyzed by GC-MS. Control incubations without any added substrate were done simultaneously and then processed in an identical manner.

6. Growth and Preparation of a Crude Extract from *Synechococcus elongatus, Anabaena variabilis* and *Synechocystis*

Fifty milliliter cultures of *Synechococcus elongatus* (UTEX 2434), *Anabaena variabilis* (UTEX B2576), and *Synechocystis* sp (UTEX 1598) were prepared using BG-11 in an identical manner to *N. muscorum* as described above. After 3 days of incubation at 30° C. the cells were harvested by centrifugation at 10,000×g for 30 min. The cells were suspended in extraction buffer and sonicated at 4° C. (4×30 sec with 1 min rest intervals). After re-centrifuging at 10,000×g for 30 min, the resulting supernatants were removed and assayed for enzyme activity using phenylbutyric acid as the substrate as described above.

Experiments Using *K. Rhizophilia, M. luteus*

1. Growth Conditions

*Kocuria rhizophilia* (ATCC 533) and *Micrococcus luteus* (ATCC 4698) and were grown in an incubator at 28° C. using freshly prepared sterile nutrient broth. *Escherichia coli* B5 was grown at 37° C. also in nutrient broth. Cultures were maintained on nutrient agar plates that were prepared from nutrient broth supplemented with 1.5% (w/v) Bacto-agar. Starter cultures were prepared by inoculating 5-mL of nutrient broth in test tubes with ATCC 533, ATCC 4698 from plates and incubating the cultures at 28° C. and the B5 organism at 37° C. overnight. Approximately 15-mL of the starter cultures were then used to inoculate 1 to 2-L of nutrient broth. The cultures were then incubated (with shaking) for 48 h at either 28 or 37° C., as described above.

2. Preparation of a Crude Extract of ATCC 533, ATCC 4698 and B5

After incubation for 48 h, the cultures were transferred into 250-mL centrifuge bottles and centrifuged at 6,500×g for 30 min. The resulting bacterial pellets were suspended in buffer (50 mM Tris pH 7.3 containing 5 mM EDTA). ATCC 533 and 4698 were then passed through a French pressure cell at 12,000 lbs/in$^2$ four times to disrupt the cell membranes. All cell suspensions were kept on ice during the disruption. The broken cell extracts were made 200 μg/mL in chicken egg white lysozyme (Specific Activity 23,900 units/mg) and stirred for 1 h at room temperature. After incubation, the solution was centrifuged at 6,500×g. The supernatant yielded the first extract. The sedimented material was then re-suspended in Tris buffer containing EDTA and an additional 20 mg of lysozyme was added and stirred 3 h at room temperature. The incubation mixture was then centrifuged as before and the resulting supernatant was the second extract. The remaining cellular debris was examined visually it was found that about 70% of the bacterial cells had been disrupted using the above extraction process.

The combined extracts (1 and 2) were made 40% saturated in ammonium sulfate by the slow addition of solid, enzyme-grade ammonium sulfate. The suspension was stirred overnight at 4° C. and the resulting precipitate was centrifuged at 10,000×g for 30 min. The supernatant was carefully removed and then made 60% saturated in ammonium sulfate by the adding more solid ammonium sulfate and stirred for another 4 h. The protein precipitate from the first precipitation (40% saturation) was dissolved in a minimum amount of 50 mM Tris buffer (pH 7.3). After centrifuging, using the same conditions as described above, the precipitate from the 60% saturation was dissolved in 50 mM Tris buffer pH 7.3. To remove the salt from the protein solutions, both dissolved precipitates were dissolved in buffer and transferred into dialysis tubing, and dialyzed exhaustively against 3 4-L changes of 50 mM Tris pH 7.3 buffer. The amount of protein in each of the extracts was determined. Enzyme activity was assessed using the thin layer chromatography (TLC) assay described below.

3. Determination of Enzyme Activity in *K. rhizophilia* and *M. luteus*

Enzyme activity was assessed by a chromatography based assay using phenylbutyric acid as the substrate. In a total volume of 0.15-mL contained enzyme and 41 mM phenylbutyric acid in 50 mM Tris buffer pH 8 containing 1 mM $MgCl_2$ and 1 mM DTT. Incubations were done in 1.5-mL microcentrifuge tubes for time intervals ranging from 1 to 24 h at 30° C. in a temperature controlled water bath. Three other potential substrates, trans-styrylacetic acid, indan-2-carboxylic acid, 2-cyclopentene-1-acetic acid were also tested at concentrations of 41, 41 and 53 mM respectively. The progress of the reaction was monitored by removing 5-μL aliquots from the incubation mixture, and spotting them onto silica-based TLC plates that incorporated an ultraviolet indicator. The plates were then dried thoroughly. The products of the enzyme reaction were separated from the starting material using a 5% ethyl acetate-heptane solvent system. Products were visualized using either an ultraviolet lamp set at 254 nm or by iodine vapor. The resulting Rf's of the products were compared with the Rf of the expected product from a decarboxylation reaction using phenylbutyric acid as the substrate, propyl benzene.

In order to determine if cofactors affect product formation pyridoxal phosphate, adenosine phosphate, pyridoxamine hydrochloride, nicotinamide adenosine dinucleotide (NADH) and ascorbic acid were included in the assay mixtures at concentrations of 1.1 mM, 1.9 mM, 1.1 mM, 0.09 mM and 1.5 mM respectively. The product formation was compared to identical incubation mixtures that did not include the particular cofactor.

4. Trial Separations Using an Extract from *K. Rhizophilia* (ATCC 533) and Ion Exchange Resins One gram each of DEAE-, QAE-, CM- and SP-Sephadex™ were prepared according to the manufacturers specifications in 50 mM Tris buffer pH 7.3. Four milliliter (bed volume) columns of each of the ion exchange resins were made and a 5-mL sample of the extract was loaded on to each column at a flow rate 2.5 mL/min. After the protein solution was added, the columns were washed with 5 volumes of buffer to remove all of the non-adherent proteins. Each of the columns were washed with 15-mL aliquots of Tris buffer with increasing concentrations of NaCl (concentrations were 0.1, 0.2, 0.3 and 0.5 M NaCl). Five milliliter fractions were collected throughout the process and each of the fractions were assayed for protein levels and fractions that contained protein were assayed for enzyme activity.

5. Trial separations Using an Extract from *K. rhizophilia* (ATCC 533) and Hydrophobic Resins One gram each of Phenyl- and Butyl-Sepharose were prepared according to the manufacturers specifications in 50 mM Tris buffer pH 7.3 containing 40% (w/v) ammonium sulfate. 0.3-mL samples of each of the resins were placed in 1.5-mL microcentrifuge tubes. To each of the resins, was added 0.5-mL of the ATCC 533 extract containing 40% ammonium sulfate and incubated on an end-over-end rotator for 2 h at 4° C. The resins were allowed to settle and the supernatants carefully removed. The resins were then washed 4 times with 0.5-mL volumes of buffer containing 40% ammonium sulfate to remove the non-adherent protein. Each of the washes was saved for protein determination. The bound proteins were selectively eluted by washing the resins with 0.5 mL of buffer containing reduced amounts of salt (30, 20, 10% and no ammonium sulfate). The resins were then washed with 0.5-mL of buffer containing a detergent (1% Triton X-100). All of the 0.5-mL samples were assayed for protein levels. The results indicated that both hydrophobic gels bound a significant amount of protein, so a larger trial separation using Butyl-Sepharose was performed.

Four milliliters (bed volume) of Butyl-Sepharose was prepared and a 5-mL sample of the extract containing 40% ammonium sulfate was loaded onto the column (flow rate 2.5 mL/min). After the protein solution was loaded, the columns were washed with 5 bed volumes of buffer containing 40% ammonium sulfate to remove all of the non-adherent proteins. The column was then washed with 10-mL aliquots of Tris buffer containing decreasing concentrations of $(NH_4)_2SO_4$ (concentrations were 30%, 20%, 10% and no salt). The column was finally washed with 25-mL of buffer with 0.05% added Triton X-100 detergent. Five milliliter fractions were collected throughout the process and each of the fractions were assayed for protein and those that contained protein were also assayed for enzyme activity (described above).

6. Trial Separations Using an Extract from *K. rhizophilia* (ATCC 533) and Affinity Resins Blue-Sepharose and Palmitoyl-Toyopearl A 5-mL column (bed volume) of Blue-Sepharose was prepared according to the manufacturers specifications in 50 mM Tris buffer pH 7.3. Ten milliliters of the crude extract was loaded onto the column and then equilibrated with the resin for 2 h at 4° C. After equilibration, the column was washed with 10 column volumes of 50 mM Tris buffer pH 7.3 to remove all of the non-adherent proteins. The Blue-Sepharose column was then washed with 40-mL aliquots of pH 7.3 Tris buffer with increasing concentrations of NaCl (concentrations were 0.1, 0.5, 1 and 2 M NaCl). Ten milliliter fractions were collected throughout the process and each of the fractions were assayed for protein levels. Fractions that contained protein were assayed for enzyme activity. Experiments using palmitoyl-Toyopearl were performed in an identical manner using a 5-mL column of the Toyopearl resin.

7. Large Scale Incubation of Enzyme from *K. rhizophilia* and Phenylbutyric Acid Phenylbutyric acid (5 mg, 30.4 μmol) was dissolved in 0.5-mL of 50 mM Tris buffer pH 8 containing 1 mM $MgCl_2$ and 1 mM DTT. One milliliter of the enzyme solution was added to the reaction mixture and was allowed to proceed for 18 h at 30° C. in a temperature controlled water bath. At this point an additional 0.5-mL of enzyme was added and incubation was continued for an additional 24 h. After incubation the reaction mixture was extracted with chloroform (4×0.5-mL). The chloroform extracts were combined and evaporated to dryness using a steady stream of nitrogen. The extracted material was dissolved in 200-μL of chloroform and analyzed by GC-MS. Control incubations without any added substrate were performed simultaneously and processed in an identical manner.

8. Large Scale Incubation of Enzyme from *K. rhizophilia* and Palmitic Acid

Palmitic acid (1 mg, 30.4 μmol) was dissolved in 0.2-mL of dimethylsulfoxide and then further diluted with 0.5-mL of 50 mM Tris buffer pH 8 containing 1 mM $MgCl_2$ and 1 mM DTT. One milliliter of the enzyme solution was added to the reaction mixture and was allowed to proceed for 48 h at 30° C. in a temperature controlled water bath. After incubation, the reaction mixture was evaporated to dryness using a steady stream of nitrogen and purified on a silica gel column (1×5 cm) using a 30% ethyl acetate-heptane solvent mixture. The purified products were analyzed by GC-MS. Control incubations without any added substrate were performed simultaneously and processed in an identical manner.

Gas Chromatography Mass Spectrometry

Samples were analyzed on a Hewlett Packard™ 6890 gas chromatograph with a 5973 series mass selective detector and a 30-m HP™ Rb-5MS column. The GC temperature program used for analysis was 45° C. for 5 min followed by an increase of 8° C./min to 340° C. with a final hold time of 5 minutes.

Results

1. *Nostoc muscorum* Experiments

*N. muscorum* was grown in BG-11 media for 4 days. After growth, the blue green algae were disrupted using sonication, and the protein was then precipitated with solid ammonium sulfate (60% saturation). Ammonium sulfate precipitation is a common technique used in protein purification to remove media components and cellular debris from a protein solution. It also provides confirmation that an enzyme activity is protein based since the activity could be precipitated with ammonium sulfate. The enzyme activity was then further purified by affinity chromatography using myristoyl-Toyopearl.

After an extract from UTEX 2209 was prepared, it was assayed for enzyme activity using phenylbutyric acid as a substrate. The assay involves separating the product(s) from the starting material using silica gel thin layer chromatography (TLC) plates containing a UV indicator in an ethyl acetate-heptane solvent system. Visualization of the UV active products and reactants was achieved using UV light and the relative amount of products and starting material in the reaction were determined using the intensities of the spots. The assay revealed that at least two products were generated during the reaction of phenylbutyric acid with Extract 1 from UTEX 2209 in Tris buffer at pH 8. The more polar major product had mobility (R1) of 0.4 while the minor product had an Rf of 0.8 which was similar to the Rf of the anticipated decarboxylation product, propyl benzene. These results confirm that there is a cytoplasmic enzyme activity in *N. muscorum* that converts carboxylic acids into hydrocarbons.

In order to further characterize the enzyme activity, a number of compounds were examined as potential cofactors. These compounds were tested at concentrations ranging from 0.09 to 2 mM but there was no noticeable difference in product formation when compared to control incubation mixtures without added cofactors. These results suggest that cofactors may not be required for enzyme activity.

A series of control experiments were performed to confirm that the enzyme activity observed for UTEX 2209 was unique to the *Nostoc* organism, and not general phenomena observed with all cyanobacterium. Fifty milliliter cultures of *Synechococcus elongatus* (UTEX 2434), *Anabaena variabilis* (UTEX B2576) and *Synechocystis* sp (UTEX 1598) were grown in BG-11 media, and an extract was prepared. Trial incubations with phenylbutyric acid and an extract of these organisms did not show any conversion into product suggesting that the activity observed with UTEX 2209 was unique to *Nostoc*.

Significant improvement in the overall protein yields was obtained by altering the growth time for the cultures. The results in Table 1 show that if a younger (3 day) starter culture was used to inoculate a larger amount of BG-11 media, there was an improvement in the protein yield after 4 days of incubation at 30° C. Protein yield appeared to decrease if the culture was allowed to grow for more than 4 days. Increasing the age of the starter culture (5 days) as well as using larger volumes of starter culture did not improve the overall yield of protein as well.

TABLE 1

Trial Growth Conditions for *Nostoc muscorum* (UTEX 2209)

| Culture Size (L) | Incubation Conditions | Extract 1 Total Protein (mg) | Extract 2 Total Protein (mg) |
|---|---|---|---|
| 5 | 3 day starter culture (500-mL) 4 day incubation at 30° C. | 732 | 229 |
| 5 | 5 day starter culture (800-mL) 5 day incubation at 30° C. | 103 | 40 |
| 2 | 3 day starter culture (600-mL) 5 day incubation at 30° C. | 5 | 2 |
| 1 | 3 day starter culture (300-mL) 4 day incubation at 30° C. | 6 | 4 |

Although significant improvements were made in enhancing the cell and protein yield from UTEX 2209, the enzyme activity was present in only small amounts. An attempt was made to develop a strategy to rapidly purify the enzyme activity using affinity chromatography. One approach to developing an affinity resin is to incorporate a mimic of the substrate that would be specifically recognized by the enzyme(s) leading to selective binding to the support resulting in an efficient purification or concentration of the desired enzyme(s). Previous research by others have suggested that long chain fatty acids such as myristic acid may be one of the substrates for the desired enzyme(s) in *N. muscorum*. With this information, an affinity support that incorporates myristic acid was prepared by chemically attaching myristic acid via its acid chloride derivative to an amine-based chromatography resin (Toyopearl, AF-amino-650M). The reaction proceeded smoothly with good incorporation of myristic acid onto the resin. Trial separations with the prepared myristoyl-Toyopearl were done by equilibrating the resin with an ammonium sulfate extract of *N. muscorum*. After equilibration, the Toyopearl resin was washed with buffer to remove any unbound protein. The affinity resin was then washed with buffer containing increased concentrations of NaCl ranging from 0.1 to 2 M. The results show (FIG. 1) that protein was eluted from the myristoyl-Toyopearl column using 0.1 and 0.5 M NaCl containing buffer. The protein levels in each of the eluted fractions were determined and those that contained protein were assayed for enzyme activity using phenylbutyric acid as a substrate. The results show that the majority of the enzyme activity was found in the fractions that were eluted with buffer containing 0.1 M NaCl. Very little, if any activity was found in the fractions eluted with 0.5 M NaCl.

Figure 2:
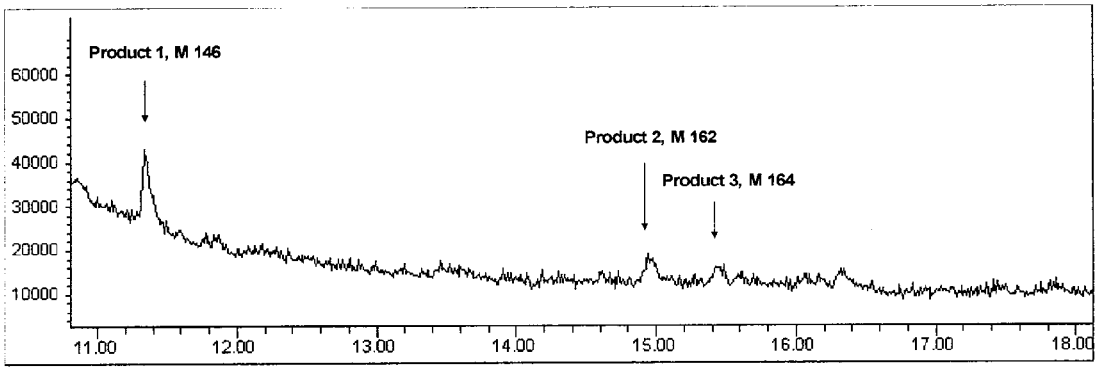
FIG. 2 shows expanded GC chromatogram showing the products generated from the reaction of 4-phenylbutyric acid with the affinity purified enzyme from *N. muscorum* (the peaks present at the retention time of 16.4 min also exist in the control incubations)

In order to gain a better insight into the mechanism of the enzyme reaction from UTEX 2209, large scale incubation was set up using the affinity purified enzyme (0.1 M NaCl eluted fraction) and phenylbutyric acid as the substrate to generate products in sufficient amounts so that they could potentially be identified. After incubation with enzyme for two days at 30° C., the reaction was terminated and then extracted with chloroform. The chloroform extract was concentrated and then analyzed by GC-MS. Three products were recovered from the reaction mixture that had molecular weights of 146, 162 and 164 with the retention times of 11.3, 15.0 and 15.4 min (FIG. 2). The fragmentation patterns of the products obtained from MS analysis were consistent with the compounds 4-pentenylbenzene with a mass of 146, 5-phenyl-2-pentanone with a mass of 162 and 5-phenyl-2-pentanol with a mass of 164. In order to explain the potential products generated in the reaction, a search of the literature was conducted to look for possible mechanisms that would explain the observed results (Bird et al. in *Chem. Soc. Rev.* 1974, 9, 1893-1898; Han. et al. in *J. Am. Chem. Soc.* 1969, 91, 5156-

5159; and McInnes et al. in *Lipids,* 1980, 15, 609-615). Mechanistic studies have shown that blue-green algae, yeasts and plants form hydrocarbons that are generally less than 20 carbons in length and are generated through elongation-decarboxylation pathways.

The results from this study clearly show that the enzyme has the flexibility to utilize a wide variety of carboxylic acid substrates considering that the substrate used in this study, 4-phenylbutyric acid is significantly different in structure from the "natural" fatty acid substrates that the enzyme utilizes in algae to generate hydrocarbons. This broad substrate specificity is important for designing a bioprocess utilizing this enzyme system for modifying the structure of organic acids to render them non-corrosive.

2. *Kocuria rhizophilia* (ATCC 533) Experiments

Effective breakage of *K. rhizophilia* ATCC 533 was achieved by passing the organism through a French pressure cell at 12,000 lbs/in$^2$ four times in combination with lysozyme treatment, achieving ~70% breakage.

Once a suitable protein extract was obtained, the protein was precipitated with ammonium sulfate at both 40 and 60% saturation. The results indicated that a significant amount of protein was precipitated with 40% $(NH_4)_2SO_4$. After extensive dialysis in 50 mM Tris buffer pH 7.3 to remove the salt, the protein extract was assayed for enzyme activity using phenylbutyric acid as the substrate. Initial incubations were done in pH 7.3 Tris buffer at 30° C. for incubation times ranging between 1 and 24 h. No product formation was observed in the reaction mixture. $MgCl_2$ and DTT were added to the pH 7.3 buffer at 5 mM concentrations of each. When further assays were conducted, no products were observed as well. After the pH of the buffer was adjusted to 8 in the presence of 5 mM $MgCl_2$ and DTT and phenylbutyric acid, two products were observed within 2 h of adding the enzyme to reaction mixture at 30° C. The major product was polar and UV active with an Rf value of 0.3. The minor non-polar product was only mildly UV active and stained with iodine vapor. The Rf for this product was 0.9. Neither product co-migrated with the anticipated decarboxylation product, propyl benzene.

Figure 3:
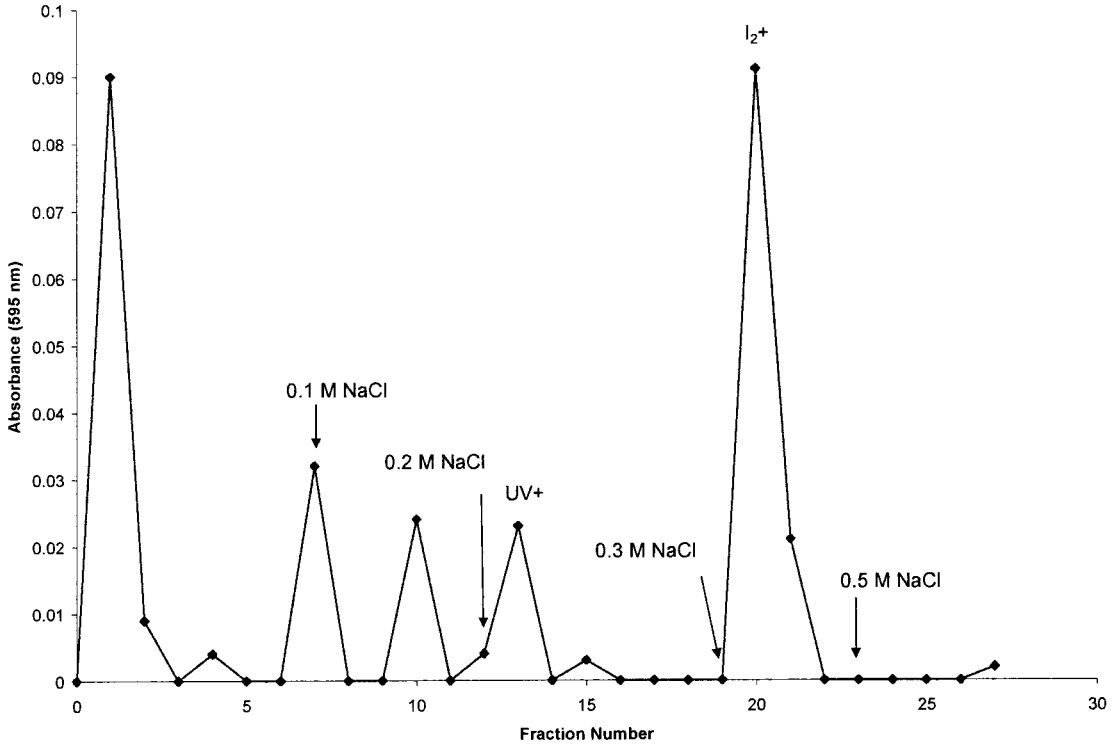
FIG. 3 is a graph illustrating the trial separation of enzyme activities from an extract from *K. rhizophilia* (ATCC 533) using QAE-Sephadex™

Small scale trial incubations with 0.3-mL samples of four ion exchange resins SP-, CM-, DEAE- and QAE-Sephadex and a semi-purified extract from ATCC 533 in Tris buffer at pH 7.3 revealed that the protein solution bound best to the strong cation and anion exchange resins SP- and QAE-Sephadex™, suggesting that the proteins may only be weakly charged. Four milliliter columns of each resin were prepared and 5-mL samples of the protein extract were passed through the resin. After the non-adherent proteins were washed off the columns with buffer containing no salt, proteins were selectively eluted from the columns using buffer solutions containing 0.1, 0.2, 0.3 and 0.5 M NaCl. The results from the separations on SP and QAE-Sephadex™ showed that two enzyme activities could be separated. The first activity that generates the more polar UV active product could be eluted in Tris buffer containing 0.2 M NaCl. The enzyme activity that generates the minor iodine staining product could be eluted using buffer containing 0.3 M salt. An example of the purification profile using QAE-Sephadex is shown in FIG. 3. Using strong ion exchange resins, a purification of over a hundred fold (based on protein) was realized. This type of process, involving stepwise elution of protein with increasing salt concentrations, is amenable to large scale separations that will be required for obtaining sufficient quantities of enzymes for use in a bioupgrading capacity.

Figure 4:
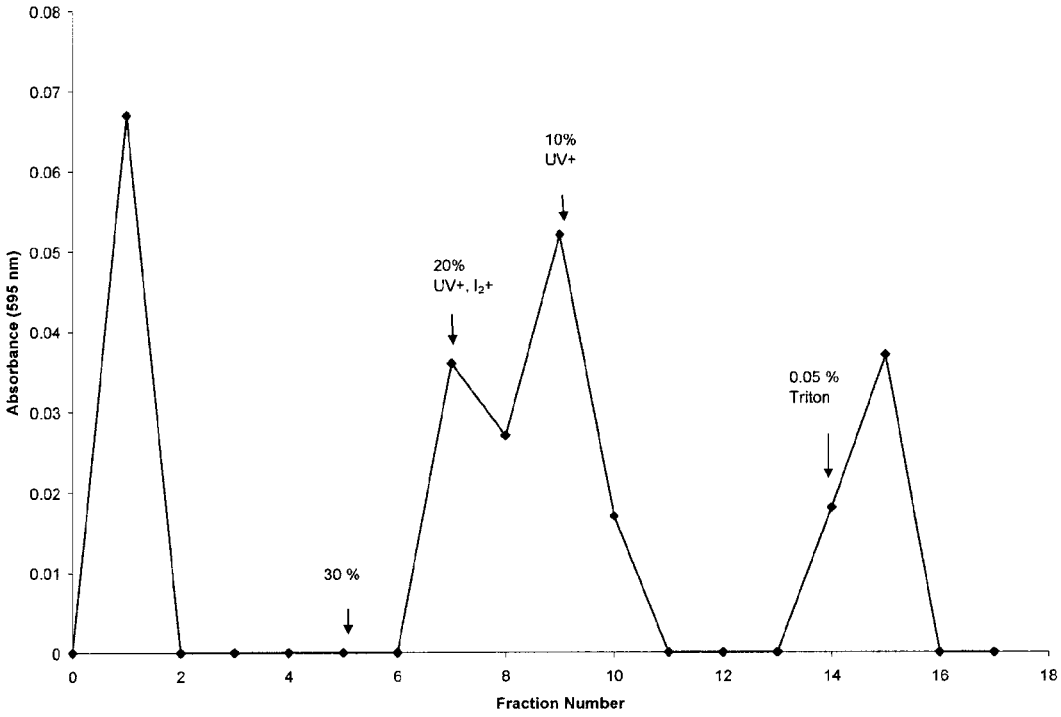
FIG. 4 is a graph illustrating the trial separation of enzyme activities from an extract from *K. rhizophilia* (ATCC 533) using Butyl-Sepharose™

The results from the preliminary ion exchange experiments revealed that the proteins in the extract from ATCC 533 may be only weakly charged, since only the strong ion exchange resins could bind a large amount of protein. This suggests that the proteins may be more hydrophobic in nature, so hydrophobic resins may be a useful tool in purifying the enzyme activities. Two hydrophobic resins Phenyl- and Butyl-Sepharose, were tested. The protein extract from ATCC 533 was made 40% saturated in ammonium sulfate to increase the ionic strength in order to remove any potential for ionic interactions. The results from small scale binding experiments with the two supports indicated that a significant amount of protein could be bound to either resin. Butyl-Sepharose was selected for further experimentation. A 4-mL column of the resin was prepared and a 5-mL aliquot of the protein extract containing 40% ammonium sulfate was added. The column was washed with several bed volumes of buffer with 40% salt to remove unbound protein. The column was then washed with 5-mL volumes of buffers containing 30%, 20%, 10% and no ammonium sulfate. The column was finally washed with 25-mL of Tris buffer containing 0.5% Triton X-100 detergent. The result in FIG. 4 revealed that the two enzyme activities can be eluted with 10 to 20% ammonium sulfate containing buffer although the two activities were not totally separated.

Two attempts were made to develop alternative strategies to rapidly purify the enzyme activity by affinity chromatography supports using either a mimic of the known fatty acid substrate for the enzyme, or a known commercially available affinity support called Blue-Sepharose. This commercial resin has an attached dye compound, Cibracon Blue that mimics the structure of a nucleotide. This commercial affinity resin was used in these experiments since the enzyme activity is thought to incorporate a nucleotide binding site on the protein that regulates enzyme activity. An affinity support that incorporates palmitic acid was also prepared using an amine-based Toyopearl resin as described before with good incorporation of palmitic acid onto the resin.

Figure 5:
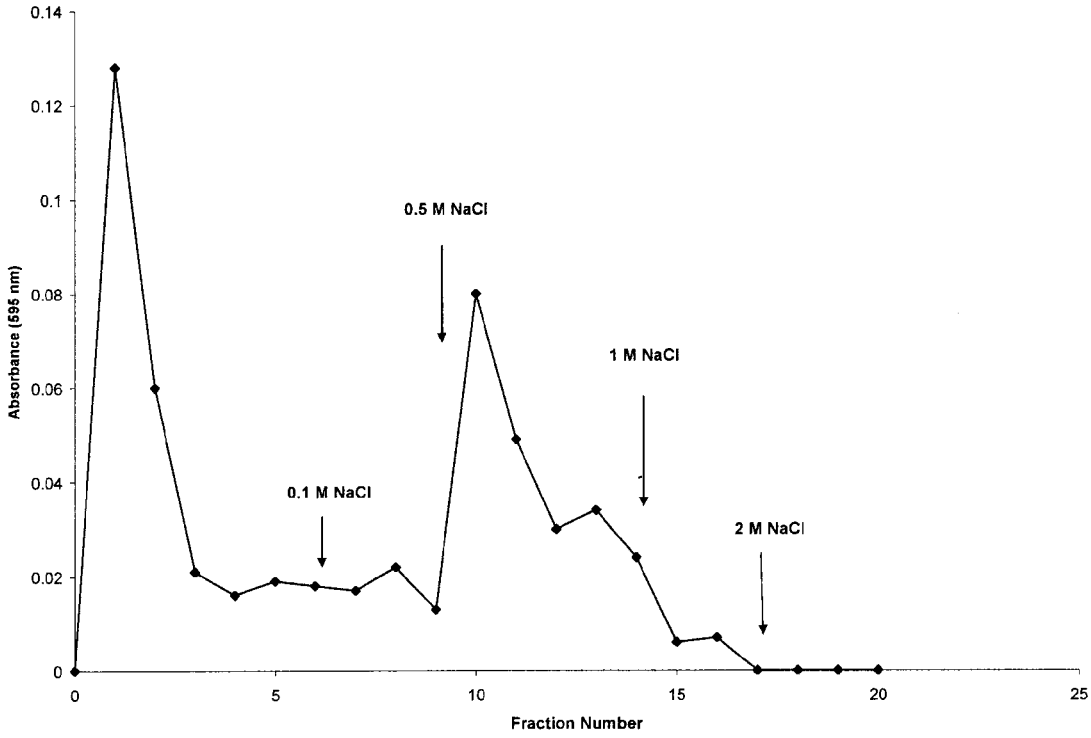
FIG. 5 is a trial purification of enzyme activities from an ammonium sulfate fraction from *K. rhizophilia* ATCC 533 using Blue-Sepharose™
Figure 6:
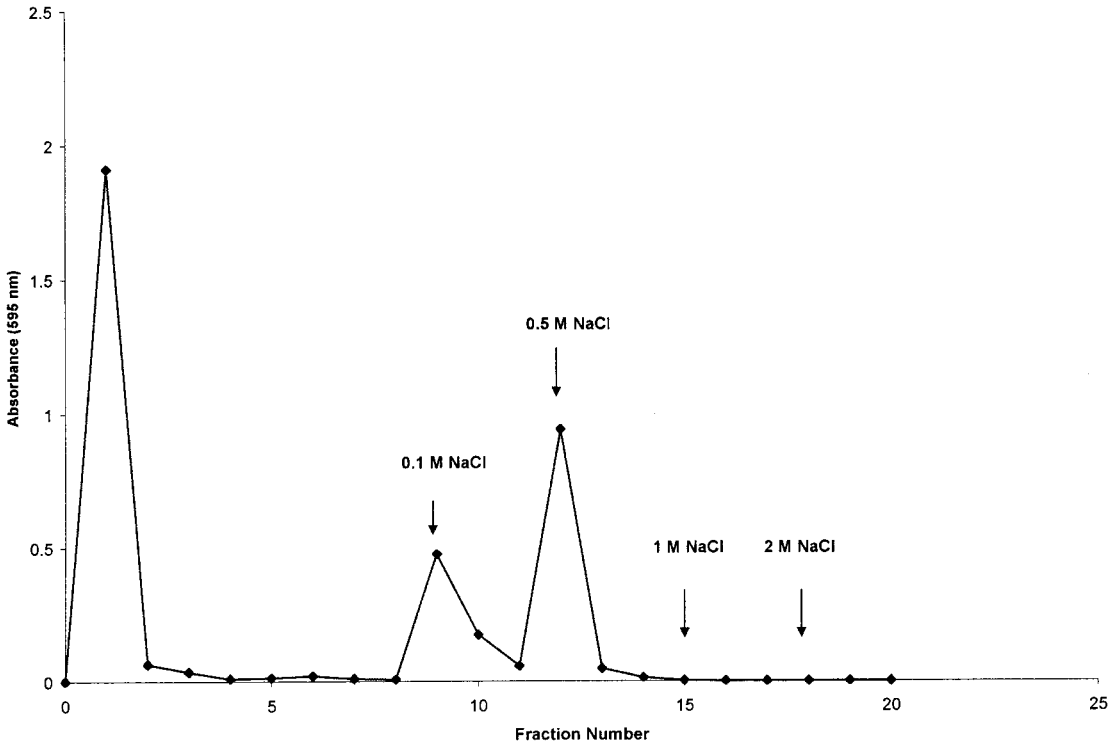
FIG. 6 is a trial purification of enzyme activities from an ammonium sulfate fraction from *K. rhizophilia* ATCC 533 using palmitoyl-Toyopearl™

Trial separations were done by equilibrating the palmitoyl-Toyopearl or the Blue-Sepharose resin with an ammonium sulfate extract from *K. rhizophilia*. After equilibration, the resin was washed with buffer to remove any unbound protein. The affinity resin was washed with buffer containing increasing concentrations of NaCl ranging from 0.1 to 2 M. The results show (FIG. 5) that protein was eluted from the Blue-Sepharose column when using buffer containing 0.5 and 1 M NaCl. The protein levels in each of the eluted fractions were determined and those that contained protein were assayed for enzyme activity using phenylbutyric acid as the substrate. The results show that the majority of the enzyme activity was found in the fractions that eluted with buffer containing 0.5 M NaCl. Very little, if any activity was found in the other fractions eluted from the Blue-Sepharose column with NaCl. When the trial separation using palmitoyl-Toyopearl column was done, protein was eluted from the support using buffer containing 0.1 and 0.5 M NaCl (FIG. 6). The majority of enzyme activity eluted with 0.5 M NaCl buffer.

Figure 7:
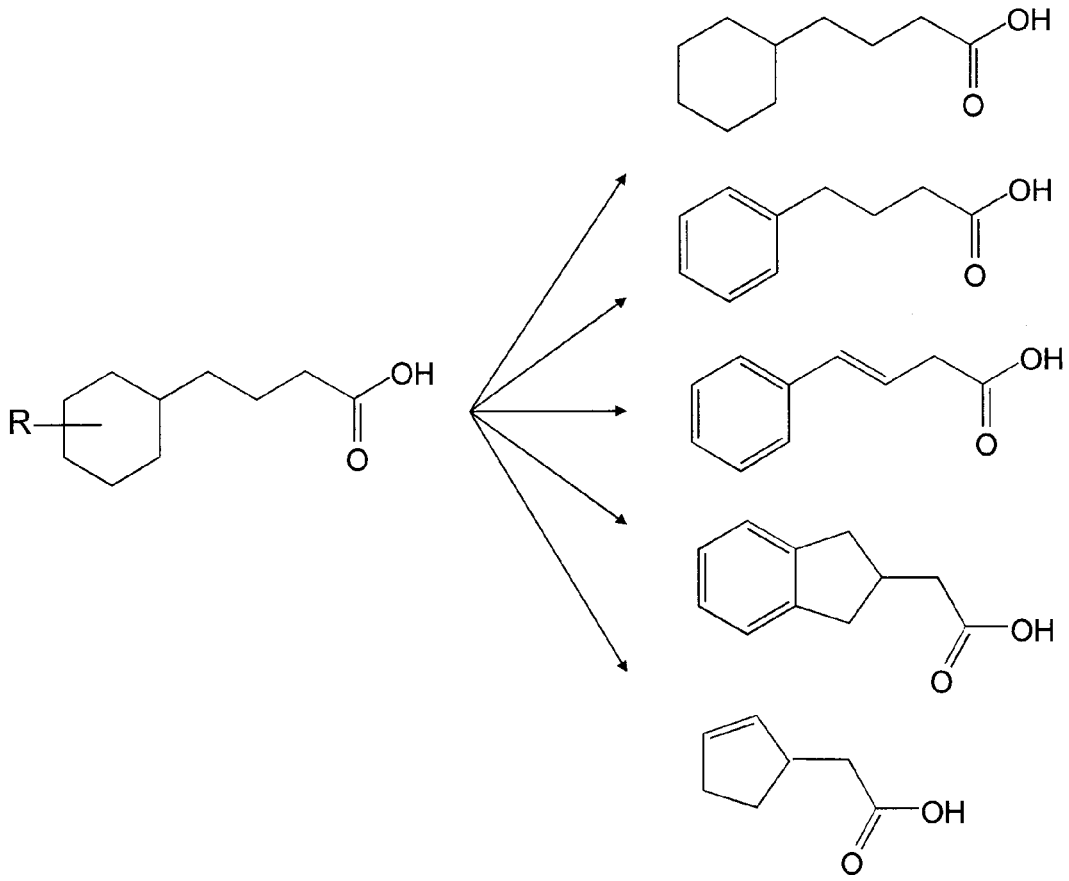
FIG. 7 is a list of organic acid model compounds used for enzyme studies
Figure 8:
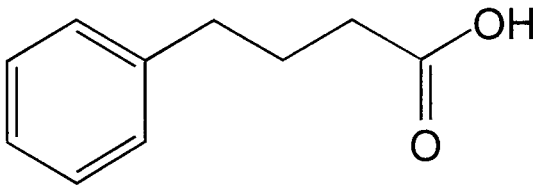
FIG. 8 lists *K. rhizophilia* (ATCC 533) substrate specificity studies
Figure 8:
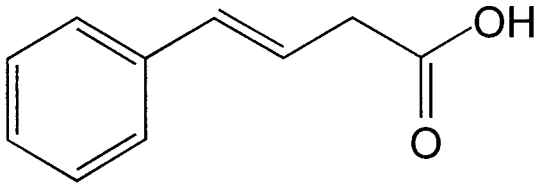
Figure 8:
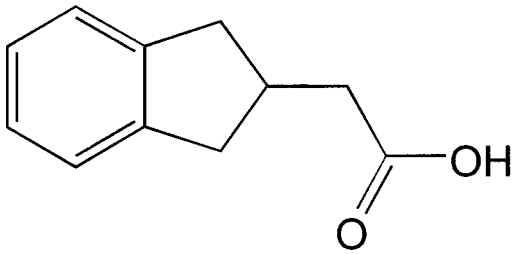
Figure 8:
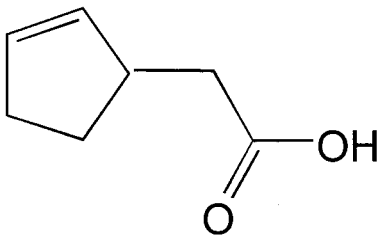

To characterize the enzyme activity from *K. rhizophilia* (ATCC 533), substrate specificity studies were carried out using compounds shown in FIG. 7. These compounds possess several common structural components which include a carboxyl group attached to cyclic ring structures through an aliphatic chain, similar to the organic acids found in petroleum. They were examined as potential substrates for the enzyme from ATCC 533. The results in FIG. 8 show that all were substrates for the enzyme and were converted into a number of different products. The enzyme seems to possess a broad substrate specificity which tolerates a variety of cyclic ring structures.

Figure 9:
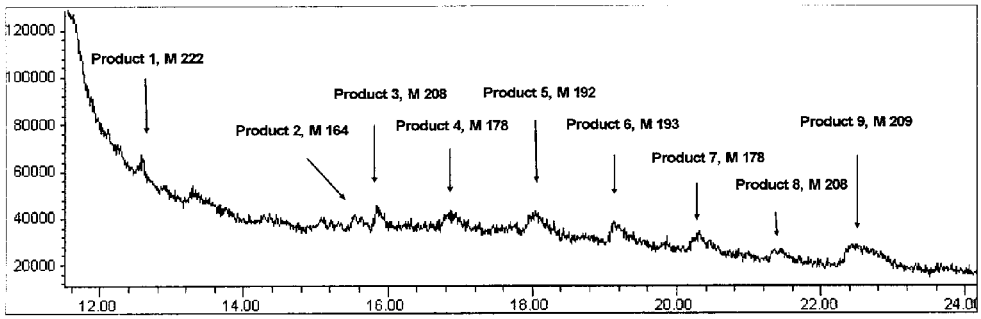
FIG. 9 shows a GC chromatogram showing the products generated from the reaction of 4-phenylbutyric acid with the affinity purified enzyme from *K. rhizophilia* (the peaks present at the retention times of 13.3 and 15.0 min also exist in the control incubations)
Figure 10:
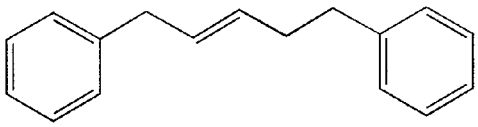
FIG. 10 illustrates the potential products identified from the reaction of 4-phenylbutyric acid with the affinity purified enzyme from *K. rhizophilia*
Figure 10:
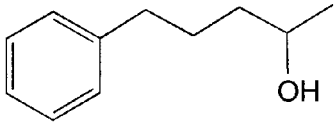
Figure 10:
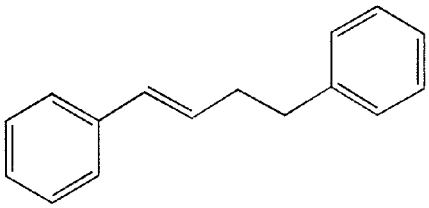
Figure 10:
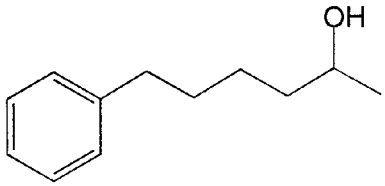
Figure 10:
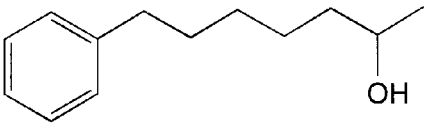
Figure 11:
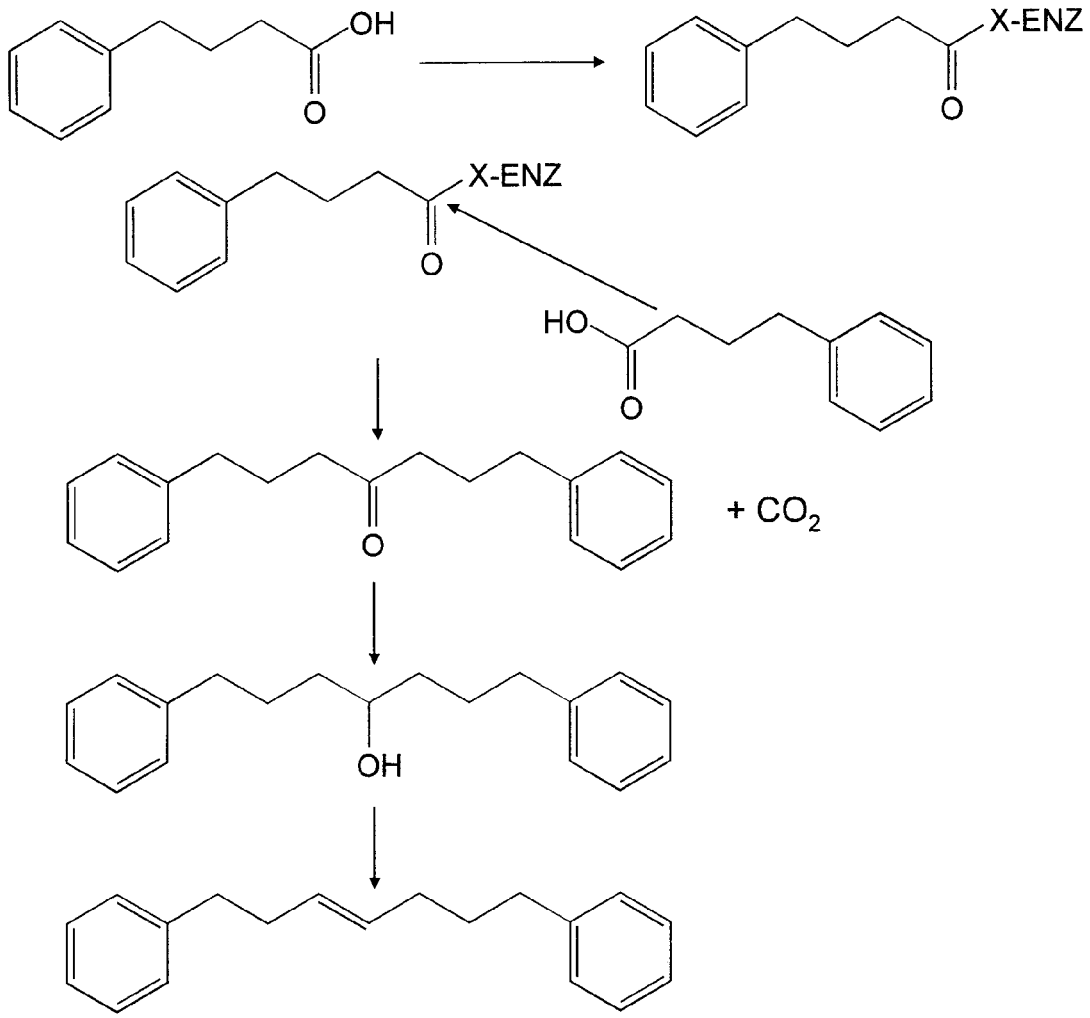
FIG. 11 illustrates the proposed mechanism for the decarboxylation reaction in *K. rhizophilia* (ATCC 533) using phenylbutyric acid as the substrate

The isolated enzyme from the Blue-Sepharose column was used to gain a better understanding of the mechanism of the enzyme reaction from *K. rhizophilia*. Large scale incubation was set up using the affinity purified enzyme (0.5 M NaCl eluted fraction) and phenylbutyric acid as the substrate to generate products in sufficient quantities so that they could potentially be identified. After incubation with enzyme for two days at 30° C., the reaction was terminated and then extracted with chloroform. The chloroform extract was concentrated and then analyzed by GC-MS. The results in FIG. 9 show that nine products were generated in the enzyme reaction with molecular weights of 222, 164, 208, 178, 192, 193, 178, 208 and 209 respectively. The first five products were identified to be the compounds shown in FIG. 10. Products one and three are structurally related to the anticipated product from the reaction shown in FIG. 11. The coupled product is expected to have a molecular weight of 250. Products one and three have molecular weights of 222 and 208 which represent the desired product minus two and three carbons. The generation of these products could potentially be explained by a possible degradation process resulting in two shorter carboxylic acids that would then condense to form the observed products. Previous research has shown that β-oxidation processes are possible when fatty acids are utilized as a substrate with an extract of *K. rhizophilia*. It is unknown whether a similar reaction is active when an alternative compound such as phenylbutyric acid is used as the substrate, but it could provide an explanation for how these products are generated.

The enzyme activities present in the purified extract from ATCC 533 also produced a series of secondary alcohols (FIG. 10), 5-phenyl-2-pentanol, 6-phenyl-2-hexanol and 7-phenyl-2-hexanol with retention times of 15.4, 16.9 and 18.0 minutes and molecular weights of 164, 178 and 192. These alcohols may be generated by an elongation-decarboxylation pathway.

Additional insight into the mechanism of the enzyme reaction was obtained by performing studies with potential cofactors. The cofactors pyridoxal phosphate, adenosine phosphate, pyridoxamine hydrochloride, nicotinamide adenine dinucleotide (NADH) and ascorbic acid were included in the assay mixtures at concentrations ranging between 0.09 to 2 mM respectively. Product formation was compared to identical incubation mixtures that did not include the potential cofactor. The results show that these compounds had no effect on product formation suggesting that cofactors are not necessary for product formation.

The invention claimed is:

1. A process for decreasing the acidity of organic acid containing crude oil, comprising:

(a) contacting an acidic crude oil containing organic acid with at least one enzyme extracted from *Nostoc muscorum* (UTEX 2209) or *Kocuria rhizophilia* (ATCC533), in a buffer solution comprising $MgCl_2$ and dithiothreitol (DTT) at a pH of 8 or between 6 and 8, at a temperature of 20° C. to 50° C. and ambient pressure, and (b) incubating the mixture obtained from step (a) under suitable conditions to convert the acids in the crude oil to non-acidic hydrocarbon products.

2. The process according to claim 1, wherein the pH is at 8.

3. The process according to claim 1, wherein the temperature is 30° C.

4. The process according to claim 1, wherein the incubation in step (b) is carried out for 1 to 5 days.

5. The process according to claim 4, wherein the incubation in step (b) is for 24 hours.

6. The process of claim 1, wherein the at least one enzyme is in solution.

7. The process according to claim 1, wherein the at least one enzyme is in insoluble form mobilized onto an inert support.

* * * * *